US012123676B2

(12) United States Patent
Huang

(10) Patent No.: US 12,123,676 B2
(45) Date of Patent: Oct. 22, 2024

(54) MAGAZINE CATCH AND GUN HAVING THE SAME

(71) Applicant: Yong-Fong Huang, New Taipei (TW)

(72) Inventor: Yong-Fong Huang, New Taipei (TW)

( * ) Notice: Subject to any disclaimer, the term of this patent is extended or adjusted under 35 U.S.C. 154(b) by 0 days.

(21) Appl. No.: 18/177,698

(22) Filed: Mar. 2, 2023

(65) Prior Publication Data

US 2023/0324137 A1 Oct. 12, 2023

(30) Foreign Application Priority Data

Mar. 22, 2022 (TW) ..... 111110497

(51) Int. Cl.
*F41A 9/59* (2006.01)
*F41A 17/38* (2006.01)

(52) U.S. Cl.
CPC ..... *F41A 9/59* (2013.01); *F41A 17/38* (2013.01)

(58) Field of Classification Search
CPC ..... F41A 17/38; F41C 3/00
See application file for complete search history.

(56) References Cited

U.S. PATENT DOCUMENTS 4,521,985 A * 6/1985 Smith ..... F41A 17/38 42/7
4,539,770 A * 9/1985 Bornancini ..... F41A 35/06 42/7
4,599,818 A * 7/1986 Fedora ..... F41A 17/38 42/7
4,747,224 A * 5/1988 Smith ..... F41A 17/38 42/7
4,759,144 A * 7/1988 Egan ..... F41A 35/06 42/7
4,768,301 A * 9/1988 Thomas ..... F41A 35/06 42/7
4,835,892 A * 6/1989 Ruger ..... F41A 17/38 42/7
6,141,895 A * 11/2000 Rost ..... F41A 17/38 42/6
9,541,340 B2 * 1/2017 Fluhr ..... F41A 35/06
9,964,372 B1 * 5/2018 O'Clair ..... F41A 35/06
10,161,701 B2 * 12/2018 Paquette ..... F41A 17/38
10,234,226 B1 * 3/2019 Copeland ..... F41A 17/38
10,365,058 B1 * 7/2019 Miller ..... F41A 17/38
11,624,573 B1 * 4/2023 Blazek ..... F41A 9/59 42/6
2009/0031605 A1 * 2/2009 Robinson ..... F41A 33/06 42/2

(Continued)

*Primary Examiner* — Joshua E Freeman
(74) *Attorney, Agent, or Firm* — HSML P.C.

(57) ABSTRACT

A magazine catch is adapted to be mounted in a gun body and to be pressed for releasing a detachable magazine. The magazine catch includes a press member and a catch member. The press member has a first main body, and a press portion and a first engaging portion that are connected to opposite ends of the first main body. The catch member has a second main body, and a catch portion and a second engaging portion that are respectively connected to two opposite ends of the second main body. The catch portion is disposed for engaging with the detachable magazine. The second engaging portion and the first engaging portion are separably engaged with each other such that the catch member and the press member are co-movable.

8 Claims, 5 Drawing Sheets

(56) References Cited

U.S. PATENT DOCUMENTS

| | | | | |
|---|---|---|---|---|
| 2016/0069628 | A1* | 3/2016 | Fluhr | F41A 35/06<br>42/6 |
| 2017/0199000 | A1* | 7/2017 | Paquette | F41A 17/38 |
| 2023/0194198 | A1* | 6/2023 | Schrödl | F41A 35/06<br>42/6 |
| 2024/0019225 | A1* | 1/2024 | Gangl | F41A 17/38 |

* cited by examiner

MAGAZINE CATCH AND GUN HAVING THE SAME

CROSS-REFERENCE TO RELATED APPLICATION

This application claims priority to Taiwanese Invention Patent Application No. 111110497, filed on Mar. 22, 2022.

FIELD

The disclosure relates to a magazine catch, and more particularly to a magazine catch and a gun having the same.

BACKGROUND

A conventional gun such as a Glock pistol uses a magazine to load bullets, and when the bullets in the magazine are running out, a new magazine is needed to load the conventional gun with more bullets. When the magazine is to be replaced, a user must press a magazine catch to detach the magazine, and the magazine catch is connected with a resilient member to provide an elastic force to the magazine catch for restoration such that, if a force exerted on the magazine catch is released, the magazine catch can be restored by the resilient member to the original position to lock a new magazine in the conventional gun.

The magazine catch has a press portion that protrudes from one side of a grip section of the Glock pistol for the user to press. The finger size and shooting habits of each user may be different, so each user may have different preferences for the tactile surface and length of the press portion of the magazine catch. However, for the standard Glock pistol the magazine catch only has a single pattern, and the user does not have any choice for the press portion.

SUMMARY

Therefore, an object of the disclosure is to provide a magazine catch that can alleviate at least one of the drawbacks of the prior art.

According to the disclosure, the magazine catch is adapted to be mounted in an installation hole of a gun body, to be pressed by a pressing force to move from an initial position in a movement direction for releasing a detachable magazine, and to be returned to the initial position by a resilient member after the pressing force is released. The magazine catch includes a press member and a catch member. The press member has a first main body that extends in the movement direction, and a press portion and a first engaging portion that are respectively connected to two opposite ends of the first main body in the movement direction. The press portion is disposed for pressing by a user. The catch member has a second main body that extends in the movement direction, and a catch portion and a second engaging portion that are respectively connected to two opposite ends of the second main body in the movement direction. The catch portion is disposed for engaging with the detachable magazine. The second engaging portion and the first engaging portion are separably engaged with each other, such that the catch member and the press member are co-movable along an axis extending in the movement direction.

Another object of the disclosure is to provide is to provide a gun including the abovementioned magazine catch.

According to the disclosure, the gun includes a gun body, the magazine catch, and a resilient member. The gun body has a magazine receptacle space and an installation hole that communicates with the magazine receptacle space. The resilient member is disposed between the gun body and the magazine catch for biasing the magazine catch towards the initial position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
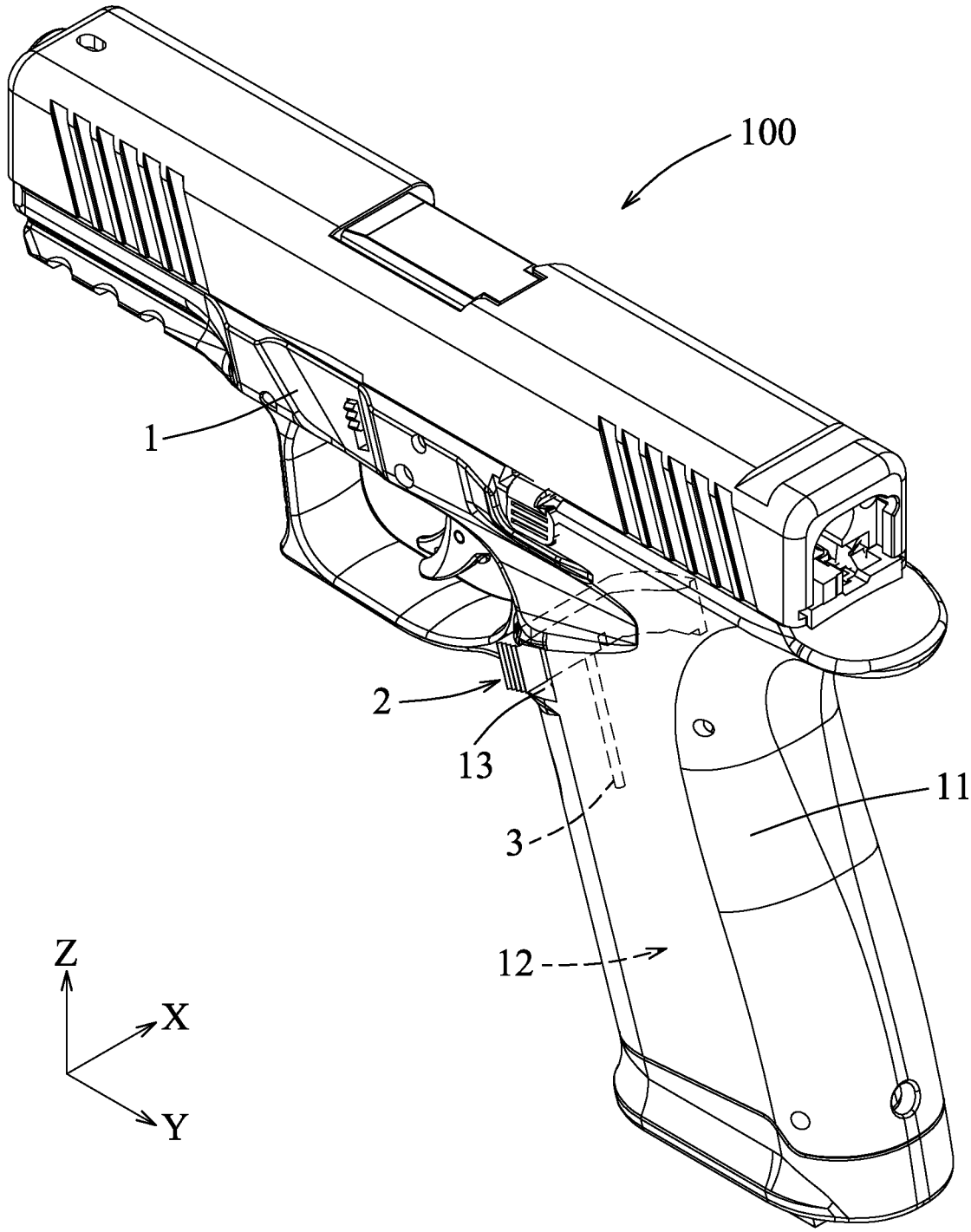
FIG. 1 is a perspective view of an embodiment of a gun according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
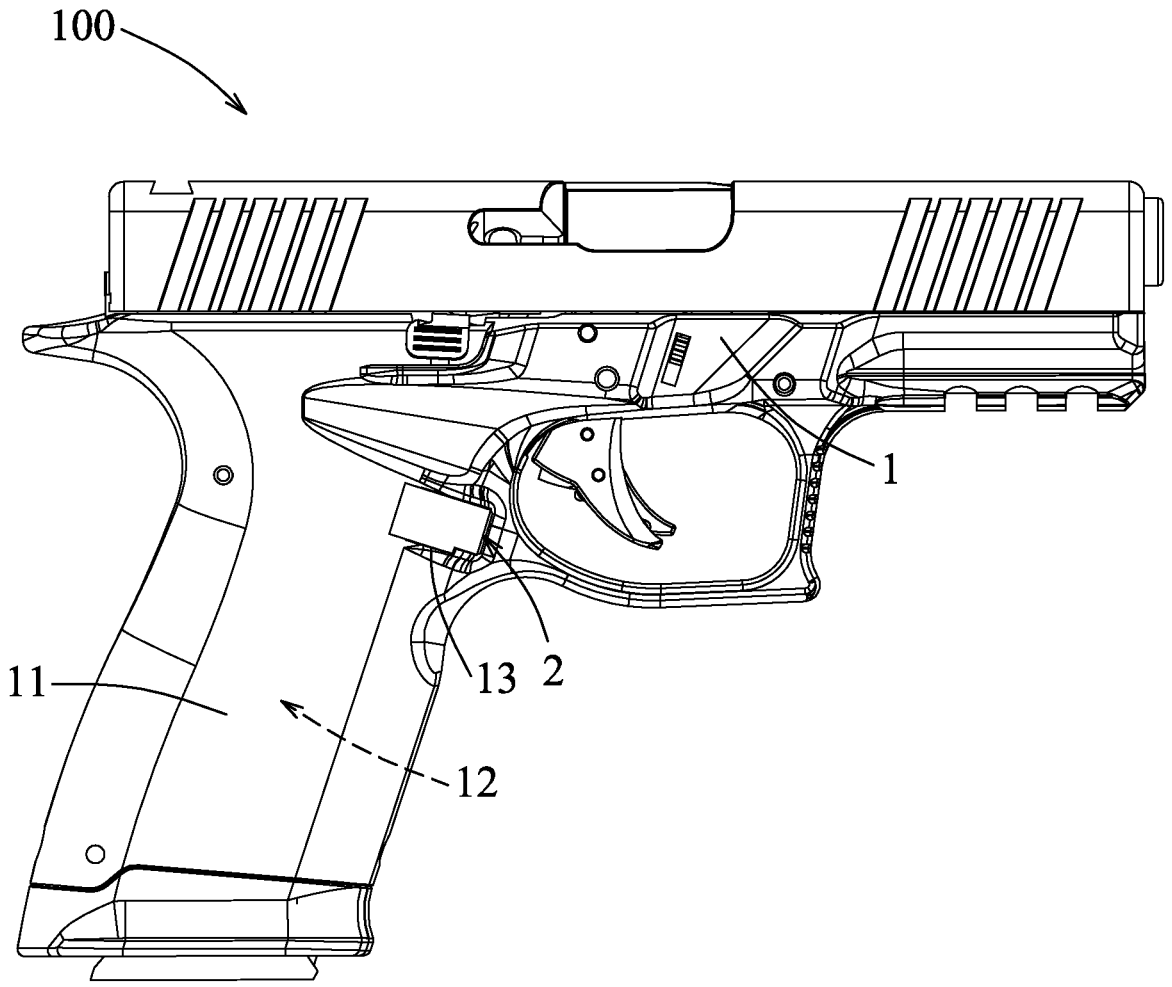
FIG. 2 is side view of the embodiment.
Figure 3:
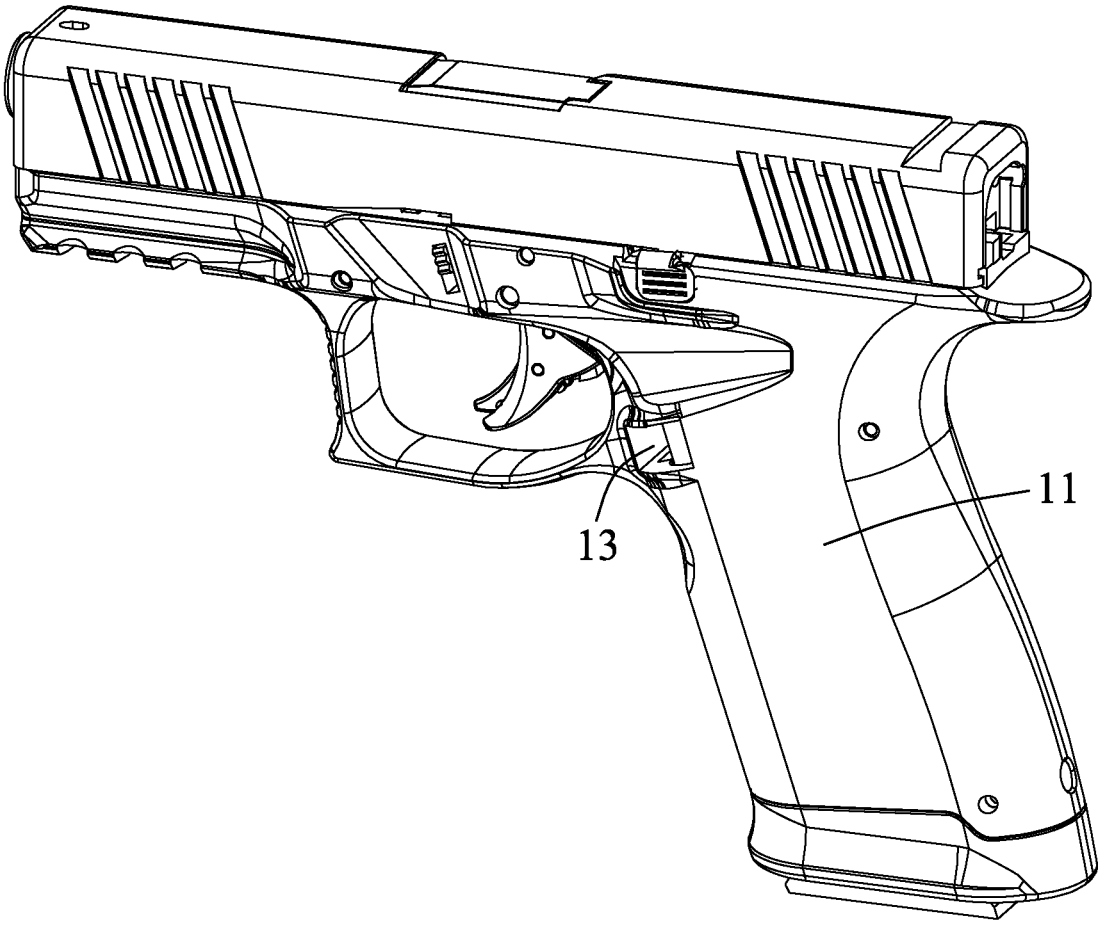
FIG. 3 is a perspective view of the embodiment with a magazine catch removed.

Referring to FIGS. 1 to 3, an embodiment of a gun 100 according to the present disclosure includes a gun body 1, a magazine catch 2 and a resilient member 3. The gun body 1 has a grip section 11, a magazine receptacle space 12 and an installation hole 13 that communicates with the magazine receptacle space 12. The magazine receptacle space 12 is located in the grip section 11, and the installation hole 13 passes through a lateral portion of the grip section 11 transversely. The magazine catch 2 is mounted in the installation hole 13, is adapted to be pressed by a pressing force to move from an initial position in a movement direction (X) for releasing a detachable magazine (not shown), and is adapted to be returned to the initial position by the resilient member 3 after the pressing force is released. The resilient member 3 is disposed between the gun body 1 and the magazine catch 2 for biasing the magazine catch 2 towards the initial position.

Figure 4:
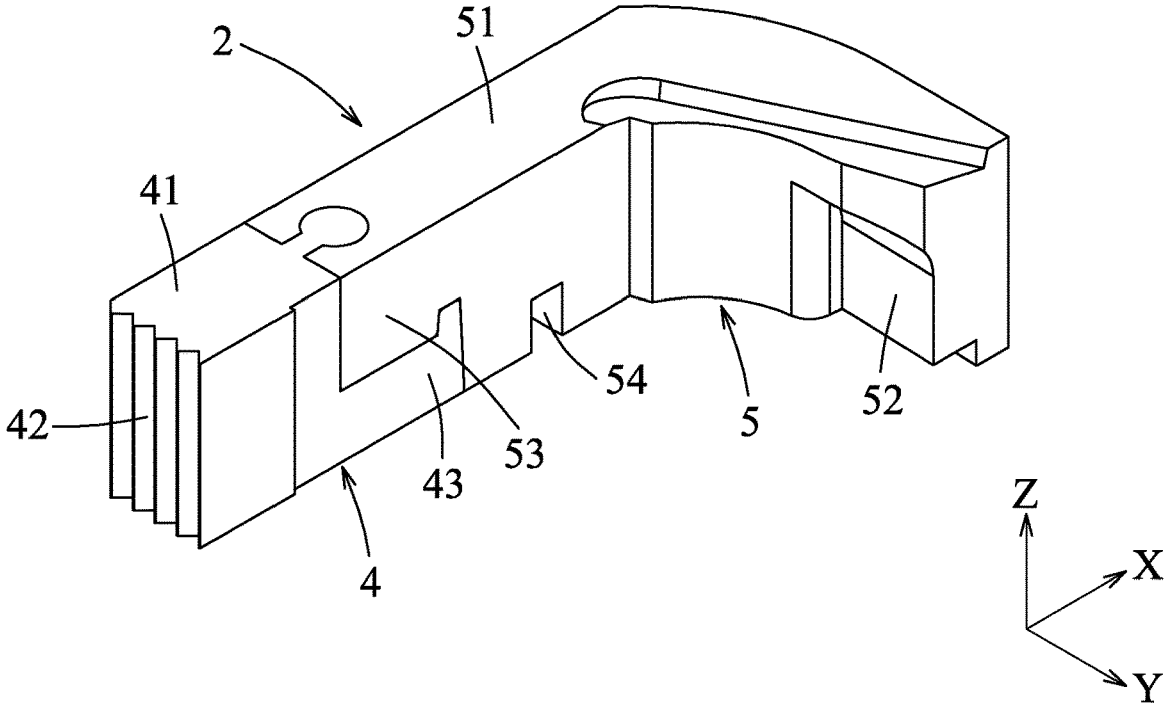
FIG. 4 is an assembled perspective view of the magazine catch.
Figure 5:
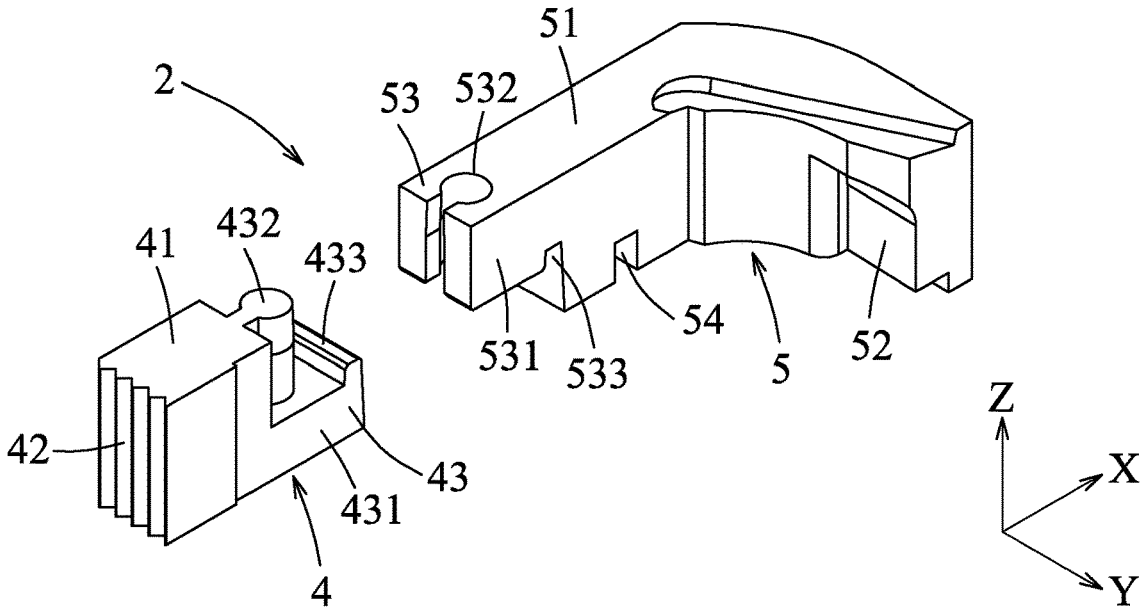
FIG. 5 is an exploded perspective view of the magazine catch.
Figure 6:
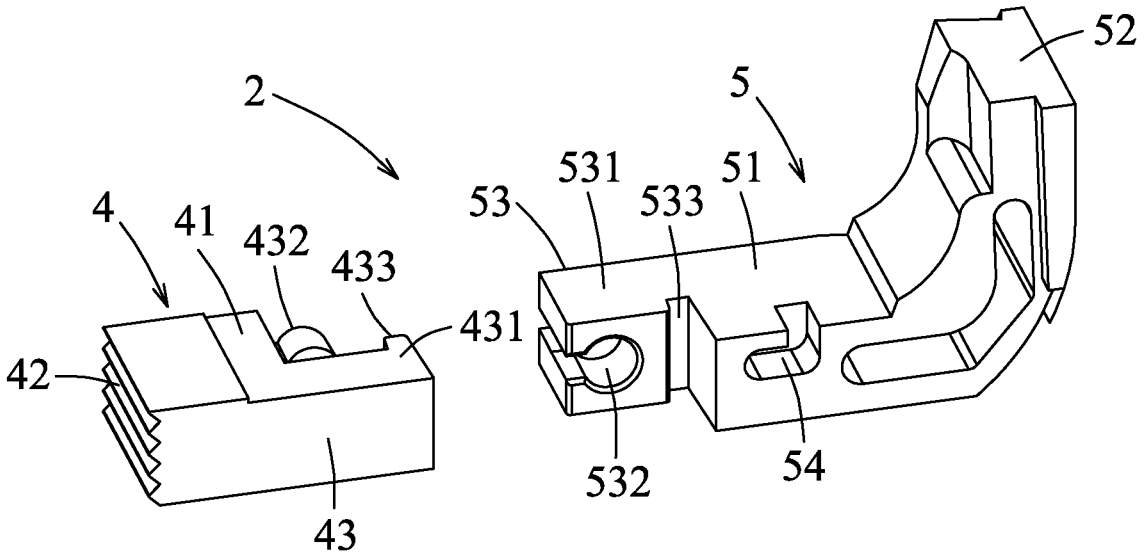
FIG. 6 is an exploded perspective view of the magazine catch from another angle.

Referring to FIGS. 4 to 6, the magazine catch 2 includes a press member 4 and a catch member 5. The press member 4 has a first main body 41 that extends in the movement direction (X), and a press portion 42 and a first engaging portion 43 that are respectively connected to two opposite ends of the first main body 41 in the movement direction (X). The press portion 42 is exposed from the grip section 11, and is disposed for pressing by a user. The catch member 5 has a second main body 51 that extends in the movement direction (X), and a catch portion 52 and a second engaging portion 53 that are respectively connected to two opposite ends of the second main body 51 in the movement direction (X). The second main body 51 is formed with a positioning groove 54 that receives one end of the resilient member 3 (see FIG. 1). The catch portion 52 is disposed for engaging the detachable magazine. The second engaging portion 53 and the first engaging portion 42 are separably engaged with each other such that the catch member 5 and the press member 4 are co-movable along an axis extending in the movement direction (X).

In this embodiment, the first engaging portion 43 and the second engaging portion 53 cooperatively form a first engagement and a second engagement. The first engagement is configured as a tongue-and-groove engagement that extends in a first direction (Z) perpendicular to the movement direction (X). The second engagement is configured as a tongue-and-groove engagement that extends in a second direction (Y) perpendicular to the movement direction (X). The first direction (Z) and the second direction (Y) are perpendicular to each other.

The first engaging portion 43 has a first base block 431, a first coupling block 432, and a second coupling block 433. The first base block 431 extends from the first main body 41 and is adjacent to the catch member 5. The first coupling block 432 is connected to the first main body 41 and the first base block 431, and extends in the first direction (Z). The second coupling block 433 protrudes from the first base block 431 at a position adjacent to a distal end of the first base block 431. The first coupling block 432 and the second coupling block 433 protrude from the same side of the first base block 431. The second coupling block 433 is rib-shaped and is elongated in the second direction (Y). The second engaging portion 53 has a second base block 531, a first coupling slot 532, and a second coupling slot 533. The second base block 531 is engaged with the first base block 431. The first coupling slot 532 is recessed from a side of the second base block 531 adjacent to the first main body 41, and fittingly receives the first coupling block 432. The second coupling slot 533 is recessed from a side of the second base block 531 adjacent to the first base block 431, and fittingly receives the second coupling block 433. The first engaging portion 43 and the second engaging portion 53 form a rectangular structure. By virtue of the first engagement extending and being elongated in the first direction (Z) and the second engagement extending and being elongated in the second direction (Y), the engagement between the first engaging portion 43 and the second engaging portion 53 is more stable. It can be understood that, in a variation of the embodiment, the magazine catch 2 may have only one of the first engagement (i.e., the first coupling block 432 and the first coupling slot 532) and the second engagement (i.e., the second coupling block 433 and the second coupling slot 533), or other similar engagement structures to prevent separation of the first engaging portion 43 from the second engaging portion 53 along the axis extending in the movement direction (X).

Figure 7:
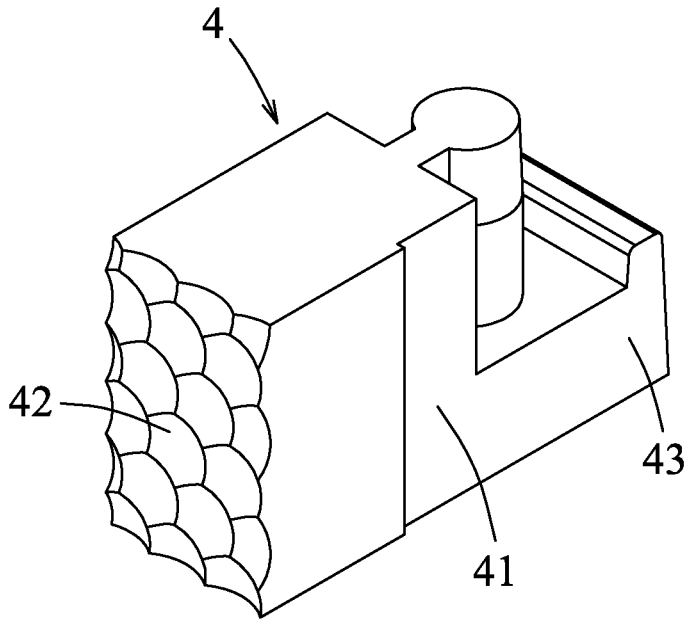
FIG. 7 is a perspective view of a press member of the magazine catch of a variation of the embodiment.

In this embodiment, the press portion 42 has a wave-like pattern. Referring to FIG. 7, in a variation of the embodiment, the press portion 42 may have a honeycomb pattern. Similarly, in other variations of the embodiment, the press portion 42 may vary in length (a longer or shorter protrusion out of the gun body 1), width and surface patterns, and the user may select the press member 4 that fulfills his/her own preferences to be then combined with the catch member 5, so as to form the magazine catch 2 that satisfies the user's requirements.

In summary, by having the second engaging portion 53 and the first engaging portion 43 separably engaged with each other, a user will only need to replace the press member 4 instead of replacing the entire magazine catch 2, thereby reducing the manufacturing cost of the magazine catch 2 and providing flexibility to the user, thereby ensuring that the user may find a press portion 42 that satisfies the user's requirements.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered (are) the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A magazine catch adapted to be mounted in an installation hole of a gun body, to be pressed by a pressing force to move from an initial position in a movement direction for releasing a detachable magazine, and to be returned to the initial position by a resilient member after the pressing force is released, said magazine catch comprising:

a press member having a first main body that extends in the movement direction, and a press portion and a first engaging portion that are respectively connected to two opposite ends of said first main body in the movement direction, said press portion being disposed for pressing by a user; and a catch member having a second main body that extends in the movement direction, and a catch portion and a second engaging portion that are respectively connected to two opposite ends of said second main body in the movement direction, said catch portion being disposed for engaging with the detachable magazine, said second engaging portion and said first engaging portion being separably engaged with each other, such that said catch member and said press member are co-movable along an axis extending in the movement direction;

wherein said first engaging portion and said second engaging portion cooperatively form a first engagement and a second engagement, said first engagement being configured as a tongue-and-groove engagement that extends in a first direction perpendicular to the movement direction, said second engagement being configured as a tongue-and-groove engagement that extends in a second direction perpendicular to the movement direction, the first direction and the second direction being perpendicular to each other.

2. The magazine catch as claimed in claim 1, wherein:

said first engaging portion has a first base block that extends from said first main body and that is adjacent to said catch member, a first coupling block that is connected to said first main body and said first base block and that extends in the first direction, and a second coupling block that protrudes from said first base block at a position adjacent to a distal end of said first base block, said first coupling block and said second coupling block protruding from the same side of said first base block;

said second coupling block is rib-shaped and is elongated in a second direction perpendicular to the first direction; and said second engaging portion has a second base block that is engaged with the first base block, a first coupling slot that is recessed from a side of said second base block adjacent to said first main body, and that fittingly receives said first coupling block, and a second coupling slot that is recessed from a side of said second base block adjacent to said first base block, and that fittingly receives said second coupling block.

3. The magazine catch as claimed in claim 1, wherein said press portion has a wave-like pattern.

4. The magazine catch as claimed in claim 1, wherein the press portion has a honeycomb pattern.

5. A gun comprising:

a gun body having a magazine receptacle space and an installation hole that communicates with said magazine receptacle space;

said magazine catch as claimed in claim 1; and a resilient member disposed between the gun body and the magazine catch for biasing said magazine catch towards the initial position;

wherein said first engaging portion and said second engaging portion cooperatively form a first engagement and a second engagement;

wherein said first engagement is configured as a tongue-and-groove engagement that extends in a first direction perpendicular to the movement direction; and wherein said second engagement is configured as a tongue-and-groove engagement that extends in a second direction which is perpendicular to the movement direction, the first direction and the second direction being perpendicular to each other.

6. The gun as claimed in claim 5, wherein:

said first engaging portion has a first base block that extends from said first main body and that is adjacent to said catch member, a first coupling block that is connected to said first main body and said first base block and that extends in the first direction, and a second coupling block that protrudes from said first base block at a position adjacent to a distal end of said first base block, said first coupling block and said second coupling block protruding from the same side of said first base block;

said second coupling block is rib-shaped and is elongated in a second direction perpendicular to the first direction; and said second engaging portion has a second base block that is engaged with the first base block, a first coupling slot that is recessed from a side of said second base block adjacent to said first main body, and that fittingly receives said first coupling block, and a second coupling slot that is recessed from a side of said second base block adjacent to said first base block and that fittingly receives said second coupling block.

7. The gun as claimed in claim 5, wherein the press portion has a wave-like pattern.

8. The gun as claimed in claim 5, wherein the press portion has a honeycomb pattern.

* * * * *